United States Patent [19]

Fukao

[11] Patent Number: 4,926,218

[45] Date of Patent: May 15, 1990

[54] IMAGE FORMING APPARATUS

[75] Inventor: Hiroshi Fukao, Osaka, Japan

[73] Assignee: Minolta Camera Kabushiki Kaisha, Osaka, Japan

[21] Appl. No.: 405,051

[22] Filed: Sep. 11, 1989

Related U.S. Application Data

[63] Continuation of Ser. No. 245,292, Sep. 16, 1988, abandoned.

[30] Foreign Application Priority Data

Sep. 19, 1987 [JP] Japan ..... 62-235586

[51] Int. Cl.[5] ..... G03G 21/00

[52] U.S. Cl. ..... 355/283; 355/298; 355/300

[58] Field of Search ..... 355/283, 298, 299, 300; 118/652; 15/256.51, 256.52

[56] References Cited

U.S. PATENT DOCUMENTS

| | | | |
|---|---|---|---|
| 3,526,457 | 9/1970 | Dimond et al. | 355/15 |
| 3,861,861 | 1/1975 | Thettu | 355/283 X |
| 3,868,744 | 3/1975 | Thettu | 355/283 X |
| 3,924,566 | 12/1975 | Dennie | 355/298 X |
| 4,165,965 | 8/1979 | Bernardelli | 355/283 X |
| 4,627,716 | 12/1986 | Oka | 355/298 |

FOREIGN PATENT DOCUMENTS

| | | |
|---|---|---|
| 59-111173 | 6/1984 | Japan . |
| 60-176079 | 9/1985 | Japan . |
| 1517756 | 7/1978 | United Kingdom . |

*Primary Examiner*—R. L. Moses

*Attorney, Agent, or Firm*—Wenderoth, Lind & Ponack

[57] ABSTRACT

An image forming apparatus provided with a transport device for discharging waste toner remained on a holding member of electrostatic latent image in an image forming section after transporting the toner onto a cleaning web arranged for cleaning fixing rollers of a fixing device. The waste toner transported and discharged by the transport device is absorbed into a wide area of the cleaning web and rolled therein since used portion of the cleaning web is rolled up. The transport device includes a mechanism for dispersing the discharged waste toner onto the cleaning web thereby collecting the waste toner in a wide area of the cleaning web.

7 Claims, 9 Drawing Sheets

IMAGE FORMING APPARATUS

This application is a continuation of now abandoned application, Ser. No. 245,292, filed on Sept. 16, 1988.

BACKGROUND OF THE INVENTION

1. Technical Field of the Invention

The present invention relates to an image forming apparatus for use in an electrophotographic copying machine, laser printer and the like, and more particularly to an improved device for collecting used waste toner discharged from an image forming unit in an image forming apparatus.

2. Brief Description of the Prior Art

Heretofore, in an electrophotographic copying machine, when the toner remained on a photoconductive drum is collected as waste toner after transfer of toner image onto a sheet of copy paper, the toner in pulverulent state has generally been collected into a waste toner container.

However, the water toner collected was sometimes used again by returning it to a developing unit and caused troubles of lowering the quality of image since the waste toner includes paper dust and the like therein. Besides, the waste toner container tends to become large in size since the pulverulent toner is voluminous and inevitably invite the necessity of providing large size image forming apparatus. For toner disposal, the waste toner container need to be removed from the device and the toner drops out of the container thereby polluting the surroundings.

Various methods have, therefore, been attempted to prevent collected toner from dispersion and for miniaturization of a waste container by reducing the volume of collected toner wherein the collected toner is liquefied by heating the waste toner container with a heater mounted on a fitting section of the container and the liquefied toner is solidified. In this connection, for example, Japanese Published Unexamined Patent Application No. 111173/1984 disclosed a method of liquefying the collected toner by a solvent.

In the prior art collecting method described above, however, it requires expensive cost for providing special means for miniaturizing the waste toner container and for preventing the dispersion of toner as well as a special space for installing the container. Moreover, it further requires additional work for disposing the toner since the collected waste toner has to be disposed.

SUMMARY OF THE INVENTION

The main object of the present invention is to provide an image forming apparatus capable of solving the problems the prior art device have had by means of utilizing a cleaning web of a fixing device for collection of waste toner so that neither a special space nor any labor for disposal of toner is required, and it can prevent the toner from dispersion Another object of the present invention is to provide an image forming apparatus capable of realizing waste toner collection by utilizing a cleaning web without encountering any dispersion of toner in leas volume wherein the cleaning web dispersively retains the toner in a wide area therein.

Still another object of the present invention is to provide an image forming apparatus capable of accomplishing waster toner collection with a simple device by dispersively retaining the waste toner within a wide area of a cleaning web.

Further object of the present invention is to provide an image forming apparatus capable of more advantageously realizing waste toner collection by dispersively retaining the waste toner within a wide area of a cleaning web so that dispersion of the toner can be prevented in less volume.

The other objects and features of the present invention will become more apparent from the following description taken in conjunction with the preferred embodiments thereof with reference to the accompanying drawings.

BRIEF DESCRIPTION OF THE DRAWINGS

It is to be noted that like device and members are designated by like reference numerals and symbols throughout the accompanying drawings of each embodiment of the present invention.

DETAILED DESCRIPTION OF THE INVENTION

Embodiments of the present invention will now be described with reference to the accompanying drawings.

Figure 1:
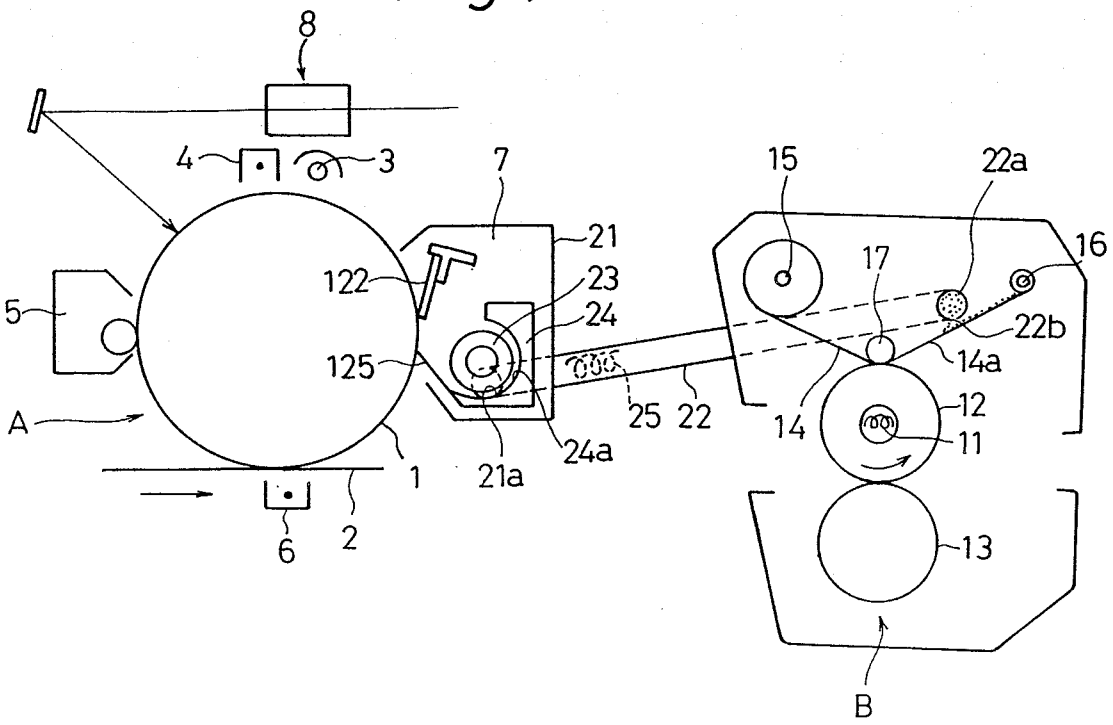
FIG. 1 is a side view showing an image forming section and a fixing device of an electrophotographic copying machine in the first embodiment of the present invention.
Figure 2:
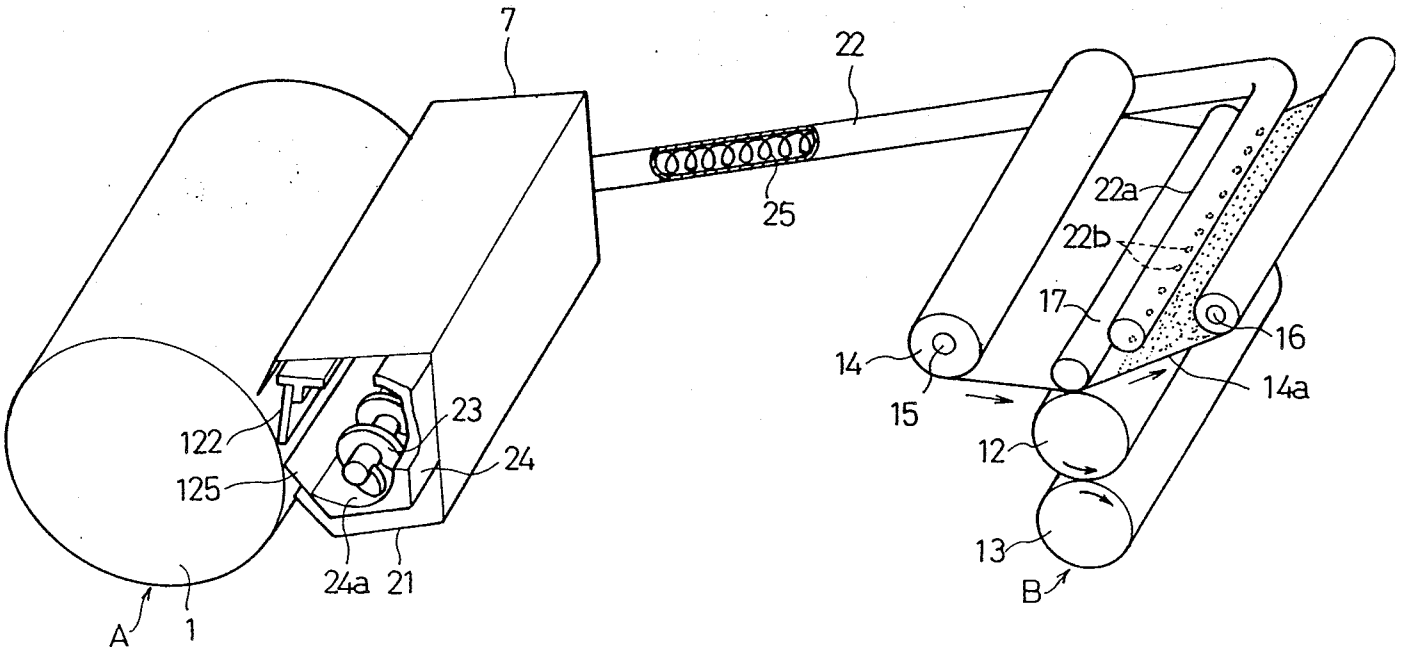
FIG. 2 is a perspective view illustrating the image forming device and the fixing device shown in FIG. 1 without casings.

FIGS. 1 and 2 show a visual image transferring type heat fixing electrophotographic copying machine in the first embodiment of the present invention.

As shown in the drawings, the copying machine has a photoconductive drum 1 and is provided with an image forming section A wherein an electrostatic latent image formed on the surface of the drum is developed into a toner image and transferred onto a transfer sheet 2 and a fixing section B wherein the transfer sheet on which the toner image is transferred at the image forming section A is processed for fixing.

Around the photoconductive drum 1 in the image forming section A, an eraser lamp 3, a charger 4, a developing device 5, a transfer charger 6 and a cleaning device 7 are sequentially disposed in the rotating direction of the photoconductive drum 1. An image is exposed by an optical system 8 on the portion uniformly charged by the charger 4 disposed opposite to the photoconductive drum 1, and an electrostatic latent image formed on the photoconductive drum 1 is developed by the developing device 5 and the image is visualized into a toner image. The visualized toner image is then transferred by the transfer charger 6 onto a transfer sheet 2 transported thereto corresponding to the rotating movement of the photoconductive drum 1.

The toner remained on the surface of the photoconductive drum 1 after the transfer is removed by the cleaning device 7, and the residual charge is removed by the eraser lamp 3 ready for next copying operation.

The fixing device B is comprised of a heat roller 12 with a heater 11 stored therein and a pressure roller 13 in pressing contact with the heat roller 12, and a cleaning web 14 is provided in contact with the upper surface of the heat roller 12. The cleaning web 14 is made long in length and is wound around a supply roller 15. As an offset preventive liquid, silicon oil is impregnated in the cleaning web, and the web is arranged to be rolled up by a take-up roller 16 through the surface of a heat roller 12 after pulled out of the supply roller 15. The web is pressed on the surface of the heat roller 12 by an elastic web feeding roller 17 whose surface is made of foam rubber and which is disposed between the supply roller 15 and the take-up roller 16. The supply roller 15 and the take-up roller 16 are driven by an unillustrated motor, by which the cleaning web 14 is successively rolled up every time when a sheet of paper is copied. The surface of the heat roller is cleaned by a sliding contact of the cleaning web 14 with the heat roller 12, and at the same time, the silicon oil impregnated in the cleaning web is coated on the surface of the heat roller 12. In the image forming section A, the residual toner after transfer on the photoconductive drum 1 is removed and discharged by the cleaning device 7.

The cleaning device 7 will be described below. At an upper portion in a casing 21, a cleaning blade 22 is disposed in pressing contact with the surface of the photoconductive drum 1, and under the cleaning blade, a spiral 23 for toner collection and a spiral holder 24 are provided in combination. The spiral holder 24 forms a toner transport channel **24*a* in which the spiral 23 is disposed and an opening toward the photoconductive drum 1. On the lower edge of the toner transport channel 24*a*, a seal plate 125 made of a thin resin sheet is provided extending obliquely upward to the surface of the photoconductive drum 1 to slidably contact therewith. Accordingly, when the toner remained on the surface of photoconductive drum 1 after the transfer reaches the seal plate 125 corresponding to the rotating movement of the photoconductive drum 1, the toner proceeds to the portion of cleaning blade 122 by pushing the seal plate 125 since the seal plate 125 is not firm and is slightly contacted with the photoconductive drum 1**.

The cleaning blade 122 is sufficiently contacted with the photoconductive drum 1 and surely scrapes off the toner remained on the drum 1. Thus, there is no bad effect in making image formation by the residual toner passing through the cleaning device. The toner scraped from the surface of the photoconductive drum 1 by the cleaning blade 122 drops onto the seal plate 125 and gets into the toner transport channel **24*a* along the seal plate 125 without leaking into the cleaning device 7 since the seal plate 125 is slidably contacted with the drum 1. The toner carried into the transport channel 24*a* is further transported by the spiral 23 and discharged as a waste toner from a toner discharge outlet 21*a* disposed on one end of the casing 21**.

The toner discharged outlet **21*a* is connected to a transport tube 22 which transports the waste toner to the used portion 14*a* of the cleaning web 14. The transport tube 22 includes a toner discharge outlet portion 22*a* transversely facing the used web portion 14*a*, and the toner discharge portion 22*a* is provided with toner discharge outlets 22*b* continuously or discontinuously disposed transversly over a wide range of the used web portion 14*a***.

The transport tube 22 has a rotatably driven coil spring 25 stored therein, and the waste toner discharged from the toner discharge outlet **21*a* of the cleaning device 7 is carried to the toner discharge portion 22*a* and thereafter, the waste toner is dispersively discharged on almost all area of the used cleaning web 14*a* through the toner discharge outlets 22*b* disposed in the toner discharge portion 22*a*. Since the cleaning web 14** is impregnated with offset preventive silicon oil, the discharged waste toner adheres well to the web without having the toner dispersed around.

Especially in this embodiment of the present invention, the waste toner is adhered to the opposite surface to the heat roller 12, and therefore, no bad effect is given to cleaning process of the heat roller 12 even if the toner is dispersed. The used web portion **14*a* which receives discharged waste toner is at almost the same or near the temperature of the heat roller 12 and, therefore, the discharged toner is subjected to melting. The waste toner permeates into the cleaning web 14** by the melting thereby preventing the waste toner from scattering and the volume of the toner becomes small since they are widely dispersed. The toner thus can not be used again.

The cleaning web 14 is rolled up by the take-up roller 16 little by little and the waste toner discharged is also rolled therein. When the take-up roller rolled up all the web, the diameter of the roll increases since the toner is also rolled up, however, such increase in diameter is not much as the waste toner is dispersed for almost all the area of the cleaning web 14. Accordingly, the space conventionally utilized is sufficient enough. Even if larger space is required, it will be not expensive when compared with the case for installing new extra waste toner collecting portion. The disposal cycle of the discharged waste toner may, therefore, be made only when cleaning web is exchanged in a frequency as low as once in 100,000 sheets of copying operation. The discharged waste toner is present around the used cleaning web portion **14*a*** and its surroundings and is solidified by cooling when copying operation is stopped thus preventing the toner from scattering while the cleaning web is exchanged.

The discharge portion **22*a* of the transport tube 22 is positioned inside the casing 25 of the fixing device B together with the cleaning web 14 and the waste toner therein is melted by thermal effect of the heat roller 12, and solidification of the toner is considered when copying operation is stopped. However, the waste toner inside the discharge portion 22*a* of the transport tube 22 is melted again when next copying operation is started and there is no problem in receiving newly discharged toner. For transport of waste toner in the discharge portion 22*a*, a screw type mechanism, for example, which has strong function for carrying and pushing may be advantageously considered. The cleaning web 14 and relative rollers 15,16,17 may be combined for making up a unit so that an exchange of cleaning web 14** and disposal of toner is conveniently made by exchanging the unit.

FIGS. 3 through 8 illustrate the second embodiment of the present invention wherein a toner discharge head 41 which moves reciprocatively on almost all area of a used cleaning web 14*a* of the cleaning web 14 shown in FIGS. 3 through 5 and 8 is disposed and a waste toner transport tube 22 is connected to the head 41. A flexible portion 22*c* which correlatively moves with the head 41 is arranged for a suitable length of the transport tube 22 on the side of the discharge head 41.

The waste toner carried to a fixing device B through the transport tube 22 is thus discharged only through the discharge head 41. However, the discharged waste toner is forcibly dispersed for almost all area of a used web portion 14*a* since the discharge head 41 moves reciprocatively on the used web portion 14*a* of a cleaning web 14. Accordingly, the discharged waste toner is dispersively collected on almost all area of the cleaning web surely and uniformly in less volume.

In this embodiment, projected spacer 41*a* is further provided at the lower corner of the discharge head 41 positioned at a discharge outlet 41*b* for maintaining a predetermined very narrow gap between the used web portion 14*a*. Thus, the dispersion of waste toner discharged onto the used cleaning web portion 14*a* through the discharge head is restrained by surrounding walls of the head 41 thereby preventing the toner from scattering outside the cleaning web 14. When the discharge head 41 is moving, even if the waste toner fell onto the used cleaning web portion 14*a* and built up thereat, it can be uniformly leveled by the lower edge of side wall 41*c* and the dispersivity of the waste toner is further improved. The discharge outlet of the discharge head 41 may advantageously be arranged to be larger so that there is no fear of waste toner jam.

Figure 3:
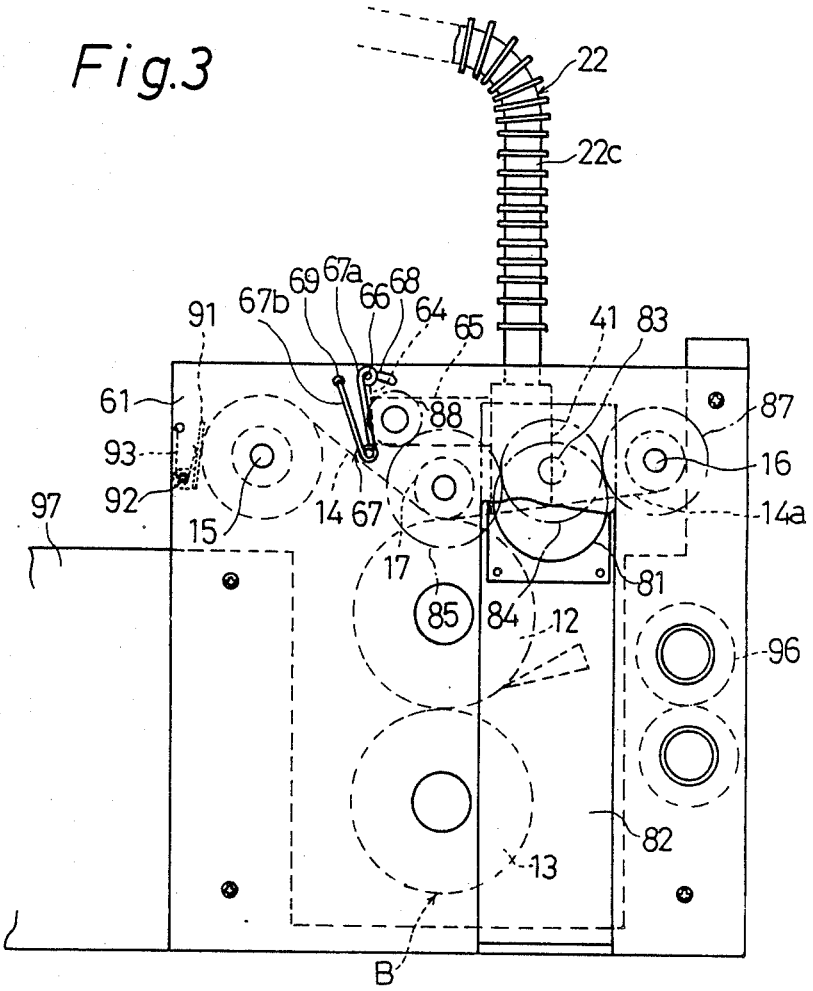
FIG. 3 is a side view of the fixing device in the second embodiment of the present invention.
Figure 4:
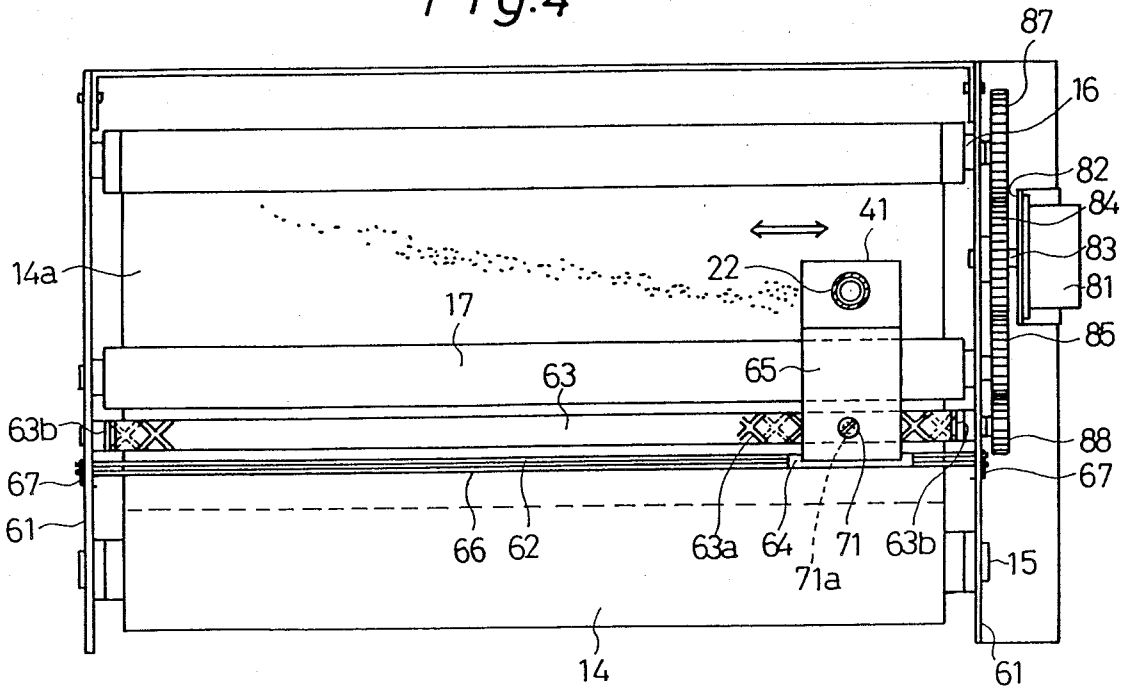
FIG. 4 is a plan view of the device shown in FIG. 3.
Figure 5:
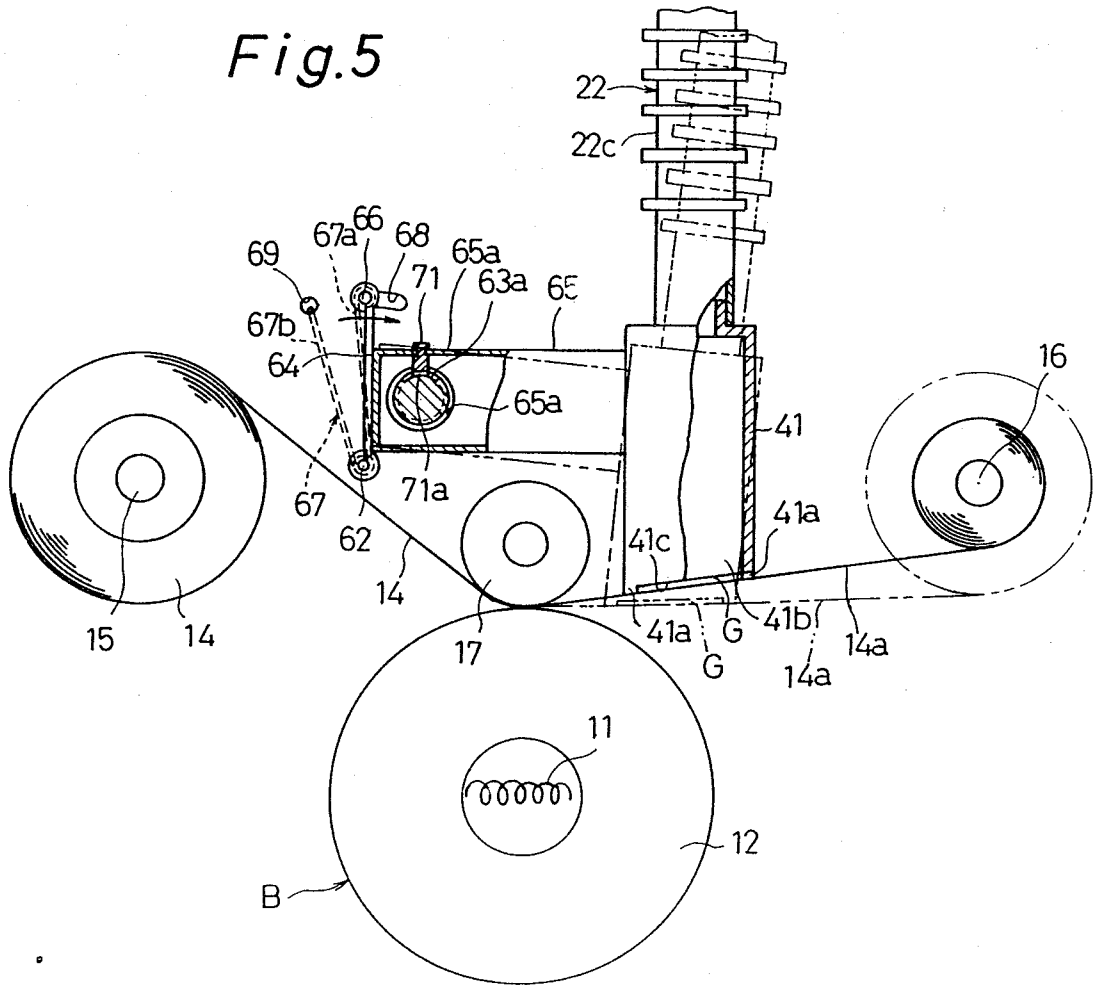
FIG. 5 is a side view of the fixing device in FIG. 3 illustrating how waste toner is discharged onto a cleaning web and how the waste toner is collected.
Figure 6:
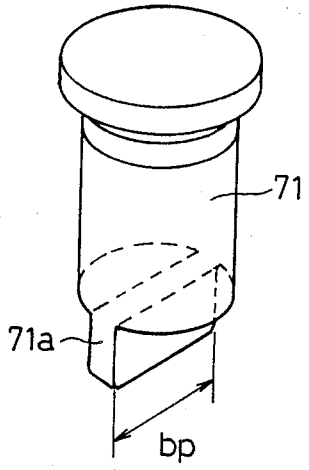
FIGS. 6 and 7 are perspective view of a in and a plan view of a devive shaft of the device shown in FIG. 3 illustrating a mechanism for making a toner discharge head in reciprocating movement.
Figure 7:
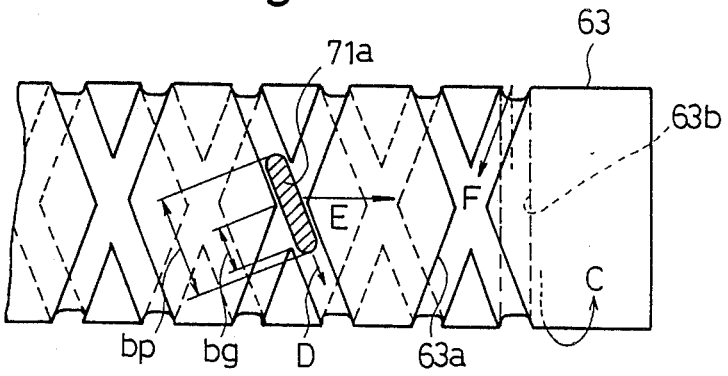
Figure 8:
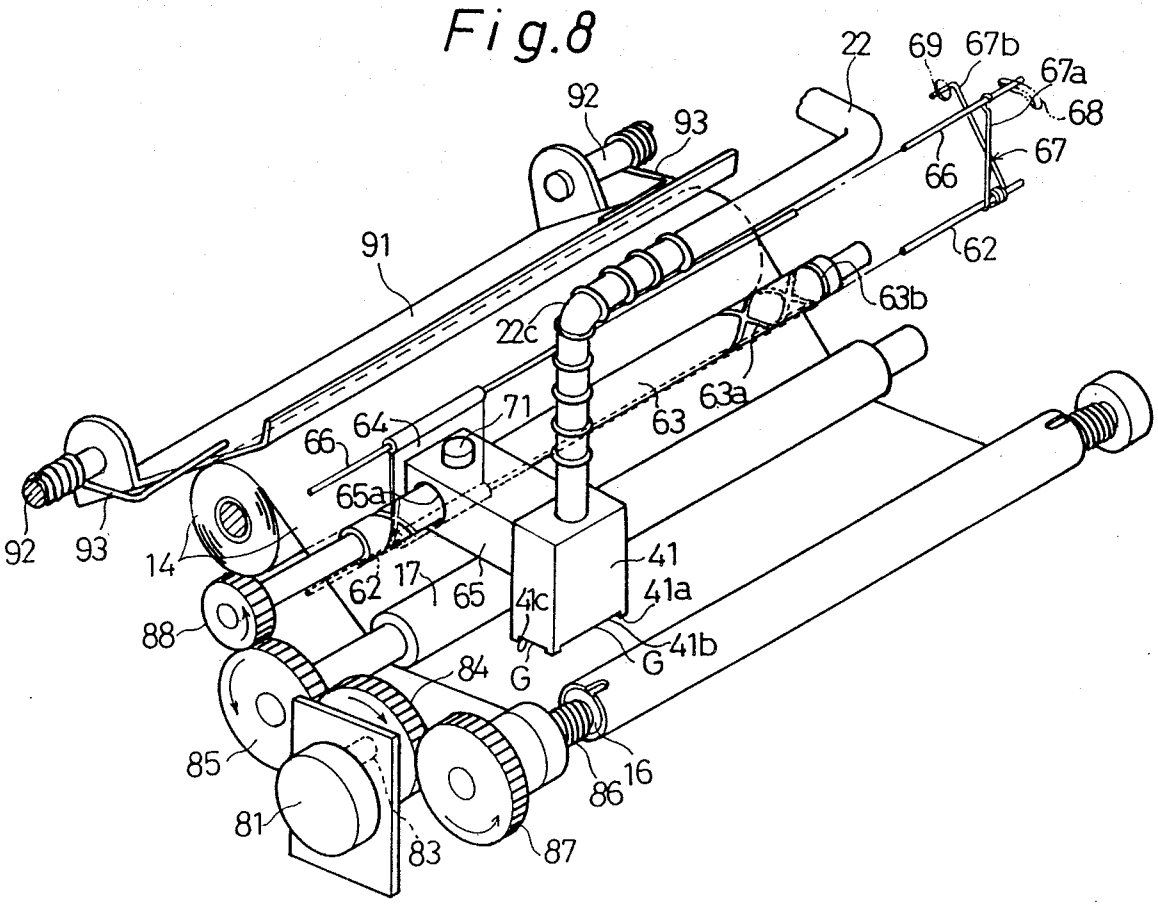
FIG. 8 is a perspective view of the device shown in FIG. 5 including a driving mechanism.

The movement mechanism of the toner discharge head 41 will be described. As shown in FIGS. 3,4, and 8, a support shaft 62 and a drive shaft 63 provided for the discharge head 41 are closely disposed between the side wall plates 61 of a fixing device B. The support shaft 62 holds a slide base plate 64 at its lower edge swayably and slidably, and the toner discharge head is fixedly attached to a tip of slider 65 projecting from the slide base plate 64. The slider 65 is engaged with the drive shaft 63 having a play at a groove 65*a* portion formed adjacent to the base of slider. With this play, the slider 65 is able to sway up and down centering on the support shaft 62 of the slide base plate 64 within a predetermined range without interfering with the drive shaft 63, and even if the position of the used portion 14*a* is changed downward or upwardly corresponding to the change of diamegter in the take-up portion of cleaning web 14 as shown in FIG. 5, the gap can always be maintained by having the head 41 in contact with the used portion 14*a* in accordance with the movement.

The contact of the head 41 with the used portion 14*a* can assuredly be maintained by its own weight with the weight of the slider 65. However, proper biasing means may advantageously be applied since the elasticity and flexibility in the flexible portion of the transport tube 22 makes the contact unstable. Accordingly, in this embodiment, a spring 67 is utilized through a movable shaft 66 slidably fitted to the slide base plate 64. The movable shaft 66 can be stably moved with the sway of slide base plate 64 by the guide of a circular arc shaped long groove 68 formed at side plates 61 of a fixing device B. One end 67*a* of the spring 67 is hooked on the movable shaft 66 in a state that its coiled portion is held on the support shaft 62 with another end 67*b* hooked on a groove 69 of the slide plate 61, and energize the slide plate 64 through the movable shaft 66 in the direction of the arrow in FIG. 5. Thus, the head 41 is able to stably contact always with the used portion 14*a* of the cleaning web.

The drive shaft 63 is formed in a manner that clockwise and counterclockwise twined both ends of spiral groove 63*a* are connected to a communication groove 63*b*, and a lower projected piece 71*a* of a movable pin 71 movably held on an upper plate 65*a* of the slider 65 is engaged with the spiral groove 63*a*. The projected piece 71*a* is arranged to have sufficiently longer width $b_p$ than the portion $b_g$ where two spiral grooves 63*a* are crossed. Accordingly, the projected piece 71*a* is provided with straightforward characteristic against the spiral groove 63*a* and even if the projected piece 71*a* is positioned at the cross portion of the spiral groove 63*a*, the projected piece 71*a* is not entered into another spiral groove 63*a* from where it is engaged with. Thus, when the drive shaft 63 is rotated in the direction of arrow C in FIG. 7, the projected piece 71*a* engaged with a spiral groove 63 in counterclockwise direction as in the figure is moved in the direction of arrow D, and consequently proceeds to the end portion of the drive shaft 63 in the direction of arrow E.

Upon reaching the end portion of the drive shaft 63, the projected piece 71*a* is moved to another spiral groove 63*a* through the communication groove 63*b* and proceeds to the direction of arrow F. The projected piece 71*a* is thus moved to opposite direction of arrow E by the rotation of drive shaft 63 in the direction of arrow C. At the another end of the drive shaft 63, the projected piece 71*a* is moved to another spiral groove 63*a* through the communicating groove 63*b* and is turned reversely. As a result, the projected piece 71*a* is made reciprocating motion within the range between both ends of the drive shaft 63 by rotation of the drive shaft 63 in the direction of arrow C. The movement of the projected piece 71*a* is transmitted to the slider 65 through the movable shaft 71, and the slider 65 is moved together with the slide base plate 64 and the toner discharge head 41 thereby making the head 41 reciprocating motion over almost all area of used portion of cleaning web. In order to stabilize the engagement of the projected piece 71*a* with the spiral groove 63*a* and the communicating groove 63*b*, it may be advantageously held in a manner that the slider 65 of the toner discharge head 41 is able to sway centering around the drive shaft 63. The drive shaft 63 is arranged to be driven by utilizing a motor 81 provided for rolling up the cleaning web 14 in common use.

For the motor 81, a geared motor with reduction gear stored therein is utilized and is attached to a support plate 82 longitudinally disposed outside of one of side plate 61 of the fixing device B. The drive gear 84 directly connected to an output shaft 83 of the motor 81 is engaged with a gear 85 on an axle of a web feeding roller 17 for driving the roller 17 while engaging with a connected gear 87 through a take-up roller 16 and a torque limiter 86 for preventing excessive transmission of torque thereby rotatably driving the take-up roller 16. By accelerating the rotation of take-up roller 16 a little more than the rotation of the web feeding roller 17, used portion 14*a* of the cleaning web 14 is always strained, and even if the circumferential speed of the take-up roller is increased because of increment of diameter, no excessive roll up of the used portion 14*a* of the cleaning web 14 is occurred. The gear 85 on an axle of the web feeding roller 17 is engaged with a gear 88 on the drive shaft 63 and drives the drive shaft 63 at a predetermined revolution ratio against the revolution of the web feeding roller 17.

A control plate 91 is provided for the cleaning web 14 on a supply roller 15 as shown in FIGS. 3 and 8. The control plate 91 is pivotally supported by a shaft 92 to the side plates 61 of the fixing device B and is in pressing contact with the cleaning web 14 on the supply roller 15 to control the rotation of cleaning web 14 thus preventing the cleaning web 14 on the supply roller 15 from sagging caused by an independent rotation of the cleaning web 14. The designated numeral 96 in FIG. 3 shows a roller for discharging a sheet after fixing disposed at the rear of fixing device B and 97 is a frame of the main body of a copying machine, and the side plates 61 of the fixing device B is screwed to the frame 97 of the main body.

Figure 9:
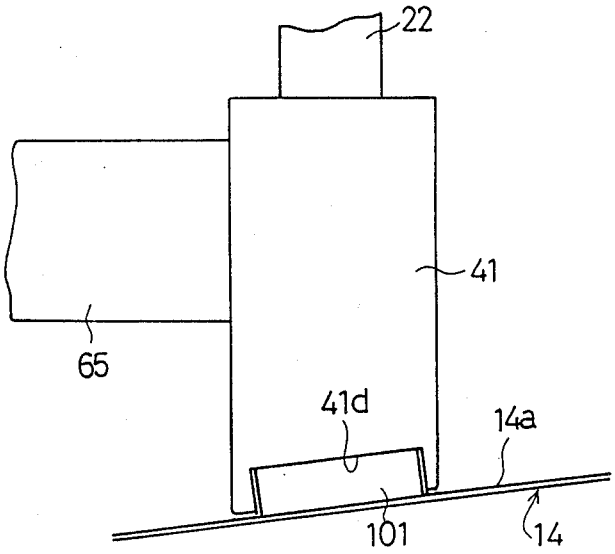
FIG. 9 is a side view of a toner discharge head in the third embodiment of the present invention.
Figure 10:
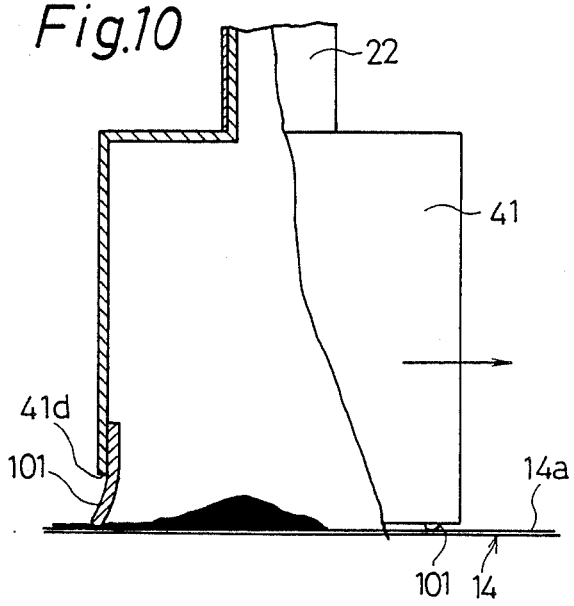
FIG. 10 is a front view showing how the toner discharge head shown in FIG. 9 is used.

In the third embodiment of the present invention shown in FIGS. 9 and 10, notch portions 41*d* are formed at the lower edge of both side plates of a toner discharge head 41 on which a flexible seal plate 101 made of rubber and resin is provided or a head 431 is arranged to move contacting with a used portion 14*a* of a cleaning web 14 at both sides of the seal plate 101. By the contact of the seal plate 101 with the used portion 14*a* of the cleaning web 14, it can surely prevent the waste toner discharged through the head 41 from scattering around. Further, when the head 41 is moved, the waste toner discharged onto the used web portion 14*a* of the cleaning web is leveled by the seal plate 101 at an upstream position in the forwarding direction of the head 41.

Figure 11:
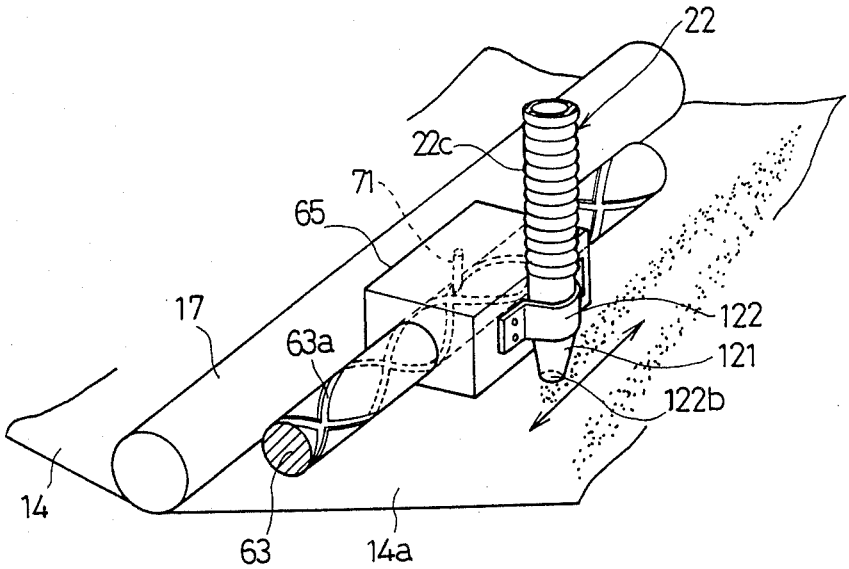
FIG. 11 is a perspective view showing how a toner discharge head is used in the fourth embodiment of the present invention.

The fourth embodiment of the present invention illustrated in FIG. 11 shows a case when a toner discharge head 121 in different form and supporting structure from the ones shown in FIGS. 2 and 3 is adopted. As shown in the drawing, the head 121 in nozzle type is connected to a transport tube 22. Similarly to the second embodiment of the present invention, a slider 65 is fitted movably and slidably to a drive shaft 63 which is provided with a spiral groove 63*a* and the head 121 is attached to one side of the slider 65 by a metal fitting 122. With this fixation, the head 121 is habituated to take a longitudinal position by the contact with the flexible portion of transport tube 22 being hung and the attachment to one side of the slider 65 while the slider 65 is stabilized in a horizontal position.

Accordingly, when the slider 65 is made reciprocating motion by the drive shaft 63 through a rotating pin 71 disposed on the upper surface of the slider, the direction of the head 121 is not changed too much even if it is affected by the expansion and contraction of the flexible portion 22*c*. Thus, the waste toner discharged onto used portion 14*a* of a cleaning web 14 through the head 121 is not dropped and discharged outside the cleaning web 14. The dispersion of waste toner can easily be prevented since a discharge outlet 121*a* is made small. Some degree of sway by the head 121 and the slider 65 help to prevent waste toner from flowing out of the outlet 121*a* of the head 121 and advantageously prevent waste toner jam.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

For example, a method of forming an electrostatic latent image by exposing an electrostatic latent image holding member in the image forming section onto a photoconductive drum has been proposed in the embodiments described above, however, the present invention includes a method of forming an electrostatic latent image by utilizing a needle electrode. Practically, the present invention may be applied to all the process of removing waste toner remained on an electrostatic latent image holding member after transferring an electrostatic latent image onto a transfer member.

The mechanisms for discharging toner remained in the image forming section and transporting the discharged waste toner onto cleaning web and the method of discharging the waste toner onto cleaning web and the like may variably be designed.

What is claimed is:

1. An image forming apparatus, comprising:

an electrostatic latent image holding member on which an electrostatic latent image is formed;

a developing means for developing the electrostatic latent image on the holding member into a toner image;

a transferring means for transferring the toner image formed on the holding member onto a transfer material;

a fixing means having a pair of rollers for fixing the toner image onto the transfer material by passing the toner image therebetween;

a first cleaning means for cleaning circumferential surface of the roller of the fixing means by a cleaning web, said first cleaning means including a take-up roller for rolling up used portion of the cleaning web;

a second cleaning means for removing the residual toner on the holding member; and a transport means for transporting the toner removed by the second cleaning means onto the cleaning web of the first cleaning means.

2. An image forming apparatus as defined in claim 1, wherein the transport means transports the removed toner onto the surface opposite to the surface in contact with the roller.

3. An image forming apparatus as defined in claim 2, wherein the roller in contact with the cleaning web is provided with a heating means.

4. An image forming apparatus as defined in claim 1, wherein the transport means transports the removed toner onto the cleaning web positioned downstream of contact area with the roller in the transporting direction of the cleaning web.

5. An image forming apparatus as defined in claim 1, wherein the transport means includes a transfer tube for transferring toner from the second cleaning means to the first cleaning means and a discharge member connected to the transfer tube having an outlet designed to transverse the cleaning web.

6. An image forming apparatus as defined in claim 1, wherein the transport means includes a transfer tube for transferring toner from the second cleaning means to the first cleaning means and a discharge member connected to the transfer tube, said discharge member being movable in the direction perpendicularly intersecting the moving direction of the cleaning web.

7. An image forming apparatus as defined in claim 6, wherein the discharge member includes a discharge outlet for discharging toner and a member for leveling toner discharged onto the cleaning web.

* * * * *